US006135127A

United States Patent [19]

Pieper

[11] Patent Number: 6,135,127

[45] Date of Patent: Oct. 24, 2000

[54] PROCESS AND MACHINE FOR TREATING FLAT SURFACES

[76] Inventor: Gerard Pieper, Gerberstrasse 5d, D-03222, Lübbenau, Germany

[21] Appl. No.: 09/142,512

[22] PCT Filed: Mar. 5, 1997

[86] PCT No.: PCT/DE97/00524

§ 371 Date: Oct. 8, 1998

§ 102(e) Date: Oct. 8, 1998

[87] PCT Pub. No.: WO97/32512

PCT Pub. Date: Sep. 12, 1997

[30] Foreign Application Priority Data

Mar. 6, 1996 [DE] Germany ..... 196 08 620
Mar. 4, 1997 [DE] Germany ..... 197 11 040

[51] Int. Cl.[7] ..... A47L 5/16; A47L 11/20; B08B 3/12; B08B 5/04

[52] U.S. Cl. ..... 134/1; 134/7; 134/10; 134/21; 134/36; 134/37; 15/346; 15/353

[58] Field of Search ..... 134/7, 21, 1, 10, 134/37, 36; 15/340.1, 345, 346, 353, 409; 451/38, 87, 88, 89, 90, 101, 102

[56] References Cited

U.S. PATENT DOCUMENTS 5,388,304 2/1995 Takada .

FOREIGN PATENT DOCUMENTS 1 503 864 3/1970 Germany .
40 39 092 C1 4/1992 Germany .
2 091 992 8/1982 United Kingdom .
2 204 783 11/1988 United Kingdom .

*Primary Examiner*—Zeinab El-Arini
*Attorney, Agent, or Firm*—Herbert Dubno

[57] ABSTRACT

A negative pressure ring is formed around the surface to be cleaned and an air flow loaded with solid particles is directed onto the surface, which based on its kinetic energy treats the surface without mechanical support means such as brushes. At overpressure the air flow creates an air-cushion-like volume flow, rotating or travelling along predetermined paths, at negative pressure a volume flow is continuously guided over the surface to be cleaned. By admixing solid particles and cleaning and maintenance agents to the air flow, the substrate can be cleaned and maintained. With the process of the invention it is possible to perform several treatment steps in a single operation. The overpressure process works periodically, the negative pressure process in a complete closed cycle, wherein the solid particles are cleaned in an environmentally friendly manner and recycled into the process.

24 Claims, 15 Drawing Sheets

PROCESS AND MACHINE FOR TREATING FLAT SURFACES

CROSS REFERENCE TO RELATED APPLICATIONS

This application is a national stage of PCT/DE 97/00524 filed Mar. 5, 1997 and based upon the German national applications 196 08 620.5 of Mar. 6, 1996 and 197 11 040.1 of Mar. 4, 1997 under the International Convention.

FIELD OF THE INVENTION

The invention relates to a process for treating (particularly cleaning), maintaining and/or polishing flat horizontal and/or vertical surfaces, such as floors and walls, wherein a volume flow of air with or without solid particles is continuously directed with negative pressure onto the surface to be cleaned, is then aspired, subsequently cleaned and lead in a closed cycle to the treatment location, whereby the solid particles are optionally superficially wetted with a liquid treatment agent, then separated from the air, separately cleaned, wetted again with the cleaning agent and fed into the volume flow.

The invention relates also to a machine for implementing the process with a mobile stand, on which a container for receiving the solid particles, a flow generator with a pressure line for the production of an air flow, a suction unit, whose suction line for the aspiration of the volume flow from the surface to be cleaned are arranged, whereby the pressure line and the suction line are connected with a floor treatment element.

The invention relates further to a process for treating (especially cleaning), maintaining and/or polishing of flat horizontal and/or vertical surfaces, such as floors and walls, whereby a volume flow of air with or without solid particles is continuously directed onto the surface to be treated, is then aspired, subsequently cleaned and lead in a closed cycle to the treatment location, whereby the solid particles are optionally superficially wetted with a liquid treatment agent, then separated from the air, again wetted with the treatment agent and reintroduced into the volume flow.

Consequently the invention relates also to a machine for implementing this process with a mobile stand, on which a container for receiving the solid particles, a fan producing negative pressure with a pressure line for the production of an air flow, a suction unit, whose suction line for the aspiration of the volume flow from the surface to be cleaned are arranged, whereby the pressure line and the suction line are connected with a floor treatment element.

In addition the invention relates to a washing and separating device for performing the cleaning and separation of air and solid particles.

BACKGROUND OF THE INVENTION

A generic method for cleaning floor coverings such as carpets and the like is known from DE-AS 1 503 864. In this method a carrier to which a liquid, chemically active cleaning agent has been applied is moved on the floor covering by mechanical force. As carrier serve solid bodies in the form of carrier particles of rubber, plastic material or the like, wetted with liquid cleaning agents, which are continuously directed in a stream to the floor covering to be cleaned, are there mechanically rubbed into the floor covering and then aspired (sucked up) and redirected in a cycle to the starting point. The carrier particles covered with dirt are then cleaned and again wetted with the liquid cleaning agent. A container is provided for the carrier particles which has opening with an adjustable cross section leading to a roller brush. In the direction of its advance, this known machine has behind the roller brush at least one suction line for the extraction of the carrier particles, which is connected with the container via a suction line, a fan and a pressure line.

Although this known system uses solid particles wetted with cleaning fluid in a cycle with an integrated cleaning device, the release of the dirt is still achieved only by mechanical friction of the solid particles on the floor to be cleaned by using a roller brush, so that the machine is heavy and hard to handle. The many machine parts result in high maintenance cost.

The cleaning device consists of two containers arranged one on top of the other, one of them being provided with a rotating screening chamber filled with cleaning fluid, or solvent. After the contaminated solid particles have been fed into the screening chamber filled with cleaning fluid, the cleaning of the solid particles takes place. After the cleaning, the cleaning fluid is discharged into the bottom container and the screening chamber with the solid particles is agitated until they have reached the desired degree of wetness.

This procedure has the disadvantage that the closed cycle has to be interrupted by the replacement of the cleaning fluid. In addition the two containers with the cleaning fluid increase the weight of the machine, which shortens the time one is able to work with the machine. With this machine it is possible to perform only one cleaning step. It is not possible to carry out cleaning, maintenance and polishing in a single work operation.

From U.S. Pat. No. 5,388,304 a system for removing dust from panel-like bodies is known. This dust removing system has a cleaning head with an air discharge chamber, wherein an air jetting slit arranged perpendicularly to the panel-like body is provided. To the air discharge chamber a suction chamber with a suction slit is assigned, which sucks up the air charged with dirt particles exiting the air jetting slit. The dust removal system is equipped with a fan unit and a drive unit, which makes it possible to move the system over the floor in a blast direction.

The air discharge chamber is connected with an air discharge line and the suction chamber with a suction line, so that the air can be guided in a closed cycle.

This known cleaning system is suitable only for dry cleaning on level surfaces. It makes possible the continuous vacuuming of dirt particles into the suction stream, but not the treatment of these surfaces, for instances the application of protective coating on the floor or the polishing of the surfaces so treated.

The U.S. Pat. No. 4,168,562 describes a surface cleaning device for street cleaning and the cleaning of industrial floors by means of high-pressure water jets, to which a central suction opening has been assigned.

Furthermore the DE-G 94 20 172.2 describes a centrifugal blasting device for cleaning large inclined or curved surfaces, particularly for boat outer surfaces, which comprises a mobile blast chamber provided with an opening and with a peripheral spring-provided seal, an impact chamber and a blasting cycle with blast cleaning.

This device is not suited for the gentle treatment of horizontal and vertical surfaces such as building floors and walls.

A large number of nozzle arrangements on vacuum cleaners and other vacuuming devices are known from the prior art. Such nozzles work usually in combination with mechanical aides such as rollers (DE 25 30 126), brushes (DE 36 32 196 A1, DE 44 39 427 A1, DE 41 12 394 A1), rotors (DE 40 39 092 C1), or ultrasonic vibrations devices (DE 195 92 163 C1). None of these known nozzle arrangements is suited for the cleaning, maintenance and polishing of floors and vertical walls in a single operational step.

OBJECTS OF THE INVENTION

It is an object of the invention to improve a process of the aforementioned kind so that the cleaning, maintenance and polishing of horizontal and vertical surfaces can be carried out in one operational step, without mechanical assistance such as brushes etc., with reduced use of cleaning agents, water and maintenance agents, while at the same time insuring a high-quality cleaning with integrated environmentally friendly preparation of the cleaning agents, without the need of interrupting the cleaning process. It is another object of the invention to enhance the compactness of the cleaning machine, to shorten its setup time, to make it more user-friendly, and to improve the handling comfort considerably by reducing the weight.

SUMMARY OF THE INVENTION

This object is achieved according to the invention through the following successive steps:

a) forming a vacuum ring around the surface to be treated and shielding this surface from the outer atmospheric pressure and the inner superatmospheric pressure, b) producing at least a first air-cushion-like rotating air flow or an air flow moving along a predetermined path within the shielded surface with an overpressure (superatmospheric pressure) of 20 to 50 mbar and/or c) admixing abrasive solid particles into the overpressure air flow with a loading rate of 5 to 50% per liter of air and/or d) admixing solid particles wetted with fluid treatment agents in the overpressure air flow with a loading rate of 5 to 50% per liter of air and/or e) admixing soft solid particles in the overpressure air flow with a loading rate of 5 to 50% per liter of air and/or f) periodically discharging the dirty solid particles from the cycle through pressure balancing and/or g) separating, cleaning of the discharged solid particles and reintroducing then into steps c) and d).

h) Producing at least one second air-cushion-like rotating air flow or an air flow moving along predetermined paths within the shielded surface with an overpressure of 20 to 50 mbar.

In a further preferred feature of the overpressure process the amount of solid particles per surface and time unit can be set by a turbulence of the solid particles in the air flow in the steps c) to e). Just like in the negative pressure process, in the treatment step c) abrasive solid particles are used, consisting of granules of plastic material, glass foam, silicate or steel particles. The granulates have an irregular shape, have a sharp surface and an edge length of more than 0.3 mm.

For steps d) to e) of the overpressure process soft solid granules of plastic material, preferably styrofoam, neopolen or polyurethane, or particles of fleece and textile shreds are particularly suited. The granulates are spherical, have a diameter of 0.3 to 10 mm and have a porous surface. In this way the granulates can be wetted with sufficient amounts of fluid treatment agents, such as cleaning or maintenance agents, preferably wax, polymer, soaps or thermoplastic dispersions on a polyurethane basis.

According to a further preferred feature of the overpressure method, the dirty solid particles are cleaned with cyclones, screening devices, centrifuges or negative-pressure separators.

Also within the framework of the invention, the solid particles can be set to vibrate mechanically by means of vibration generators, for instance ultrasound generators or electric oscillating circuits, in order to free the solid particles of loose dirt.

For the overpressure process mixtures of 5 to 15% by weight of nonionic surfactants, no more than 5% by weight of anionic surfactants, the balance preservative and water-soluble solvents are used as cleaning agents.

The object is further achieved through a machine, in that the mixing device connected with the container for the admixture of the solid particles into the overpressure air flow is a valve arranged at the bottom of the container and a nozzle, and in that a device for the dosed admixture of cleaning fluid to the solid particles and at least one flow channel open towards the surface to be cleaned is provided as floor cleaning element, to each device an inlet opening with pressure line and an outlet opening with suction line are assigned on the side facing away from the surface to be cleaned, and in that the outlet opening is connected with a discharge device for the periodic separation of the solid particles from the overpressure air flow in the container, so that the connection can be turned on and off.

The flow generator produces an air flow enriched with solid particles over the floor. This overpressure air flow is applied at a certain angle to the floor in downwardly open paths or flow channels. A seal between the flow channel and the substrate guides the air flow. The solid particles from the container reach the air flow through a valve and a nozzle. Instead of the valve and the nozzle, it is also possible to use a worm drive, an injector or a cellular wheel feeder.

The mixture of air and solid particles hits the surface to be cleaned at an angle and thereby detaches the dirt with mechanical energy. The mixture is further guided over the floor. Due to adhesion forces, the dirt is collected on the solid bodies.

With the dosage device cleaning and care agents are supplied to the solid particles, so that in one work step the surface to be cleaned can be cleaned and/or maintained. The solid particles remain in the closed overpressure cycle.

When the solid particles are sufficiently loaded with dirt, a discharge from the cycle taken place in a cartridge-like replaceable container, in that the access to this container is opened by means of a shutter, valve or slider.

The guidance of the air flow over the floor is realized through a channel system open towards the floor. Thereby various possibilities exist depending on the size of the machine and the cleaning task.

According to a further feature of the invention, the air flow and solid particles guided in the flow channels can be directed longitudinally or transversely with respect to the travel direction. Depending on the task, it can make sense to set up the flow direction of the air flow or the volume flow of air and solid particles in the travel direction or against the travel direction. It is advantageous when during the application of care agents the flow direction of the volume flow is set in the travel direction, while during cleaning the opposite flow direction is used.

The orientation of the flow channels transversely to the travel direction is particularly advantageous, because this way in the successively arranged flow channels different cleaning steps can be performed.

In order to achieve a particularly effective cleaning action, the steps a) to f) are performed with different channels, i.e. different types of solid particles are supplied to individual flow channels. The first channels do a first cleaning and take up the most dirt, the middle channels continue the cleaning and the last channels apply maintenance agents and polish the floor.

Naturally it is also possible to feed the same solid particles to several adjacent flow channels. For the highest cleaning requirements the flow can be counter to the travel direction. Various types of solid particles and cleaning agents can be combined with each other so that different cleaning tasks can be perfored.

It is particularly advantageous that, just like in the case of the negative pressure process of the invention, it is possible to clean, maintain and polish in one single operation.

A further preferred feature proposes to design the flow channels rectilinearly, or as circles, spirals or arcs. The cross section of the flow channels can be shaped like a trapezoid, square, triangle or similar geometric shapes.

An arrow-shaped arrangement of the flow channels with for instance an elastically suspended path is always preferred when different work widths are required.

As long as the arrow-shaped channels are supported in pendulum fashion they adjust automatically to the work width, or the work width is changed when an obstacle is met.

A further improvement of the cleaning results when there are flow diversions in the flow channels, which produce controlled turbulence in the volume flow, whereby the volume flow is guided with a higher bottom pressure over the surface to be cleaned.

The cleaning effect can be additionally enhanced when the solid particles are set to vibrate mechanically by a vibration-producing device, for instance an ultrasound generator or an electric oscillation circuit. This effect can be used to the same extent in the cleaning of the solid particles.

The flow channels are laterally sealed off from the substrate to be cleaned by sealing lips. The sealing lip can be a simple sealing lip or a multiple sealing lip, for instance of flexible plastic material. It should prevent solid particles from falling out of the flow channel. By means of additional nozzles arranged in the sealing lip, from which an additional air flow exits in the flow direction, the intensity of the volume flow is increased. At the same time this prevents the lateral escape of the solid particles from the flow channels.

In a further preferred embodiment the contact pressure of the entire flow system onto the floor is adjustable, either with springs, impact dampers or statically with adjustment devices.

In order to be able to clean the dirty solid particles, cleaning devices are provided, which depending on the construction of the machine of the invention are moved together with the machine for the overpressure process or are arranged separately from the machine.

Cyclones, gravity filters, filter mats, drop screens can be advantageously used for rough, dry dust/dirt particles.

For the case of a decentralized cleaning in a separate cleaning device the container for the solid particles is designed as a cartridge system, which can be simply replaced. The cleaning of the solid particles take then place chemically or mechanically, for instance in a washing drum or an ultrasound bath.

It is part of the invention to heat the solid particles with steam, in order to maintain a better wetting capability of the surface to be cleaned, whereby a more effective cleaning action can be achieved.

The previously mentioned object is also achieved through the following successively performed treatment steps in which negative pressure is used.

a) forming a negative pressure ring around the surface to be treated and shielding this surface against atmospheric pressure, b) guiding at least a first volume flow in the shielded surface and vacuuming the first volume flow with a negative pressure which is stronger than the pressure of the volume flow, and/or c) guiding at least one volume flow with a load rate of 5 to 50% per liter of abrasive solid particles onto the shielded surface, whereby the negative pressure at the suction point is bigger than the negative pressure in the volume flow, and/or d) guiding of at least one air flow loaded with 5 to 50% per liter of solid particles wetted with a liquid treatment agent onto the shielded surface, whereby the negative pressure at the suction point is stronger than the negative pressure in the volume flow, and/or e) guiding at least a volume flow mixed with a load rate of 5 to 50% per liter of soft solid particles onto the shielded surface, whereby the negative pressure at the suction point is stronger than the negative pressure of the air flow, and/or f) guiding at least one second volume flow onto the shielded surface and vacuuming this second volume flow at a negative pressure which is stronger than the one in the volume flow, g) continuous separation, cleaning and renewed feeding of solid particles into the steps c) to e).

In a preferred feature of the process of the invention, before entering the shielded surface, the volume flow of the treatment steps b) to f) is divided into at least two partial flows, which directed one against the other flow towards a central suction point within the shielded surface, whereby the negative pressure at the suction point is stronger than the negative pressure in the partial flows.

Due to the oppositely directed partial flows, within the shielded surface an advantageous turbulence of the solid particles occurs, which makes the cleaning effect more even enhancing it at the same time.

Naturally it is also part of the invention when, according to a further preferred feature, the volume flow of the treatment steps b) to f) is guided without being divided over the shielded surface towards a suction point.

In a preferred embodiment of the invention process, by swirling the solid particles in the volume flow of the treatment steps c) to e) the amount of solid particles per surface and time unit can be adjusted. This makes possible a fine adjustment of the cleaning process to the requirements of the existing floor conditions and the amount of dirt.

In a further preferred feature of the invention process the amounts of air in the volume flow equal 2000 to 8000 l/min and the negative pressure equals 100 to 200 mbar, preferably 120 to 160 mbar A further preferred development of the invention process provides that the load rate of solid particles in the volume flow be of 5 to 50%, preferably 20 to 30% This insures that clogging in the pressure and suction lines is prevented.

For the treatment step c) granulates of plastic material, for instance polystyrene foam neopolen, polyurethane foam, granulates of foamed glass, silicates or steel wool are used as abrasive solid particles. These solid particles are relatively irregular in shape and have an edge length of more than 0.3 mm. Depending on the desired degree of abrasion of the upper surface layer, correspondingly adjusted harder solid particles, such as silicates, etc. are used.

For the care and polishing steps d) and e) soft granulates of plastic material, preferably neopolen, polystyrene foam or polyurethane are used, or particles of fleece, textile shreds, which are spherically shaped, have a diameter of 0.3 to 10 mm and a porous surface. For the treatment of flat surfaces the porous surface of the solid particles in superficially wetted with a liquid treatment agent, preferably cleaning agent, wax, polymers or soaps, respectively with thermoplastic dispersion agents.

Thereby it is possible to apply gently the cleaning and/or maintenance agents to the surface to be cleaned and to perform a controlled surface refining with the polishing process.

The separation of the solid particles from the volume flow and the rough separation of the loose dirt is suitably performed by cyclones, filtering devices, centrifuges or negative pressure separators. Filtering devices combined with negative pressure have proven to be particularly advantageous.

The solid particles separated this way from the volume flow are cleaned and separated in a fluid containing cleaning substances in such a way that the solid particles travel upwards in the cleaning bath, are separated in the fluid bath and are sucked out by negative pressure when they reach the surface of the liquid.

Since the densities of the cleaning fluid and of the solid particles are sufficiently different, especially in the case of plastic material granulates the separation can take place through buoyancy. This way the cleaning is achieved without additional shaking or rotating, which reduces the expenses for the separation device, as well as its weight.

In a further preferred development the solid bodies are set into mechanical vibration by vibration generators, for instance ultrasound generators, electrical oscillation circuits, etc., whereby the capability to take up the dirt is increased.

The object is furthermore achieved by means of a mobile machine, in that a supply and dosage device for the admixture of solid particles into the air flow, connected to the container, is provided at the pressure line of the fan, and that the floor treatment element is at least one rectangular, adjustably suspended flat nozzle with at least one inlet opening and a suction opening, which are enclosed by an intrinsically closed sealing lip and several outer, concentric sealing lips arranged therearound,which are laterally open, whose interstices have an injector opening connected with the suction line of the suction unit, and that for the cleaning and separation of the volume flow of air and solid particles at the suction line a washing and separation device is connected, which separates the cleaned solid bodies and feed them back to the container.

Advantageously the feeding and dosage device arranged underneath the container can be an injector. Just as suitable are a worn drive or a cellular wheel feeder.

In a preferred embodiment of the machine of the invention, on each of the outer sides of the flat nozzle an inlet opening is arranged and centrally to these two openings a suction opening is arranged. The volume flows sucked in through the lateral inlet openings run from opposite directions towards the common centrally located suction opening of the suction line, whereby a full use of the suction surface of the nozzle is insured.

It is also advantageous to arrange in succession several flat nozzles, each with a separate volume flow cycle. When thereby one nozzle is a preliminary cleaning nozzle with a simple suction air flow, the following is a cleaning nozzle with a flow with abrasive solid bodies, the subsequent one being a maintenance nozzle, for instance with solid particles vetted with wax or a coating polymer and the final nozzle being a dry nozzle acted upon again with a simple suction air flow. This makes possible a complete floor treatment in a single work operation.

Naturally it is also part of the invention to supply the nozzles with heated air of steam-saturated air, depending on the treatment task to be performed.

A further preferred embodiment of the machine of the invention proposes that the flat nozzles be suspended in front of the machine in a V-like or plough-like arrangement, so that the preliminary cleaning nozzle can vacuum the rough dirt, before the treatment nozzle cones into contact with the surface to be cleaned.

In a further preferred feature of the machine according to the invention, the flat nozzle has only one inlet opening and one outlet opening, which are arranged rectilinearly opposed to each other on the outside of the nozzle. In this case the cleaning is performed with a rectilinear volume flow, which sweeps over the surface to be cleaned from the inlet to the outlet connection piece.

In order to increase the surface to be cleaned in one work operation, advantageously two flat nozzles are rotatably connected with each other. Close to their common point of rotation the inlet opening is arranged, the outlet opening being-arranged oppositely thereto, whereby the two flat nozzles are interadjustable against a compression spring. In their rest position or the normal working position the nozzles stand at a stable angle. When an obstacle is encountered, the nozzles can be pushed aside as such as needed, after which they swing back to their initially defined position.

A larger cleaning surface can also be achieved when at least three flat nozzles are arranged staggered in succession, so that they interconnect via their inlet opening and respectively outlet opening.

The object mentioned in the introduction is further achieved through a washing and separation device, which has a container for the cleaning fluid, wherein a separation wall is arranged which dips into the cleaning fluid, is inclined against the volume flow, separates the container into a closed chamber and an upwards open chamber, the wall's dipped area being a separation screen and whose area extending above the fluid level and which is also inclined serves as a guide plate for the cleaned solid particles, whereby the guide plate is traversed by the pressure line and a conically widening auction line ends in the closed chamber above the guide plate and the bottom of the chamber communicates with a compensating container arranged above the fluid level.

The clear mesh width of the separation screen is thereby selected so that the mesh is smaller than the diameter, respectively the edge length of the solid particles, by approximately a third. This safely prevents the meshes from being clogged by the solid particles. At its end which dips into the cleaning fluid the pressure line is shaped like an elbow. It has the inclination of the separating screen. In this way it is insured that the solid particles to be cleaned exiting the elbow rise at the inclined separation screens, reach the guide plate and are forced towards the surface by the latter.

A dirt discharge sluice ends in the bottom of the closed chamber and serves for the evacuation of the dirt separated from the solid particles.

It is also part of the invention to heat the solid bodies with steam, in order to obtain a better wetting capability of the surface to be cleaned, whereby an effective cleaning action can be achieved.

The cleaning processes of the invention with overpressure and with negative pressure can each be used depending on the cleaning task and also combined, so that a great variety of horizontal surfaces such as stone floors, plastic material floors, industrial or sports floors and carpeted floors or vertical walls can be effectively cleaned.

The processes of the invention work without large amounts of water and cleaning fluid. Due to their high efficiency the processes of the invention are also environmentally friendly and effective.

By reducing the mechanical components and elements, particularly by eliminating of entire units such as brushes, brushing mechanisms, their drive, water containers, tanks for dirty water, the machines of the invention are lighter and at the same time have a more compact construction. Due to the fact that they operate in cycles, their handling and maintenance are simpler, because for instance the transversal forces generated by the floor brushes are eliminated. Due to their variable work width the efficiency per surface increases and as a result of the increased efficiency, the costs related to disposal and operation of the machine decrease. The reduced weight of the machine of the invention means lower current consumption and a more efficient energy use.

Due to all these features it is made possible that the solution of the invention meets to greater extent the complex requirements for the cleaning of horizontal and vertical surfaces with high efficiency, safety, easy maintenance, supervisory capability, compactness and in an environmentally friendly manner.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
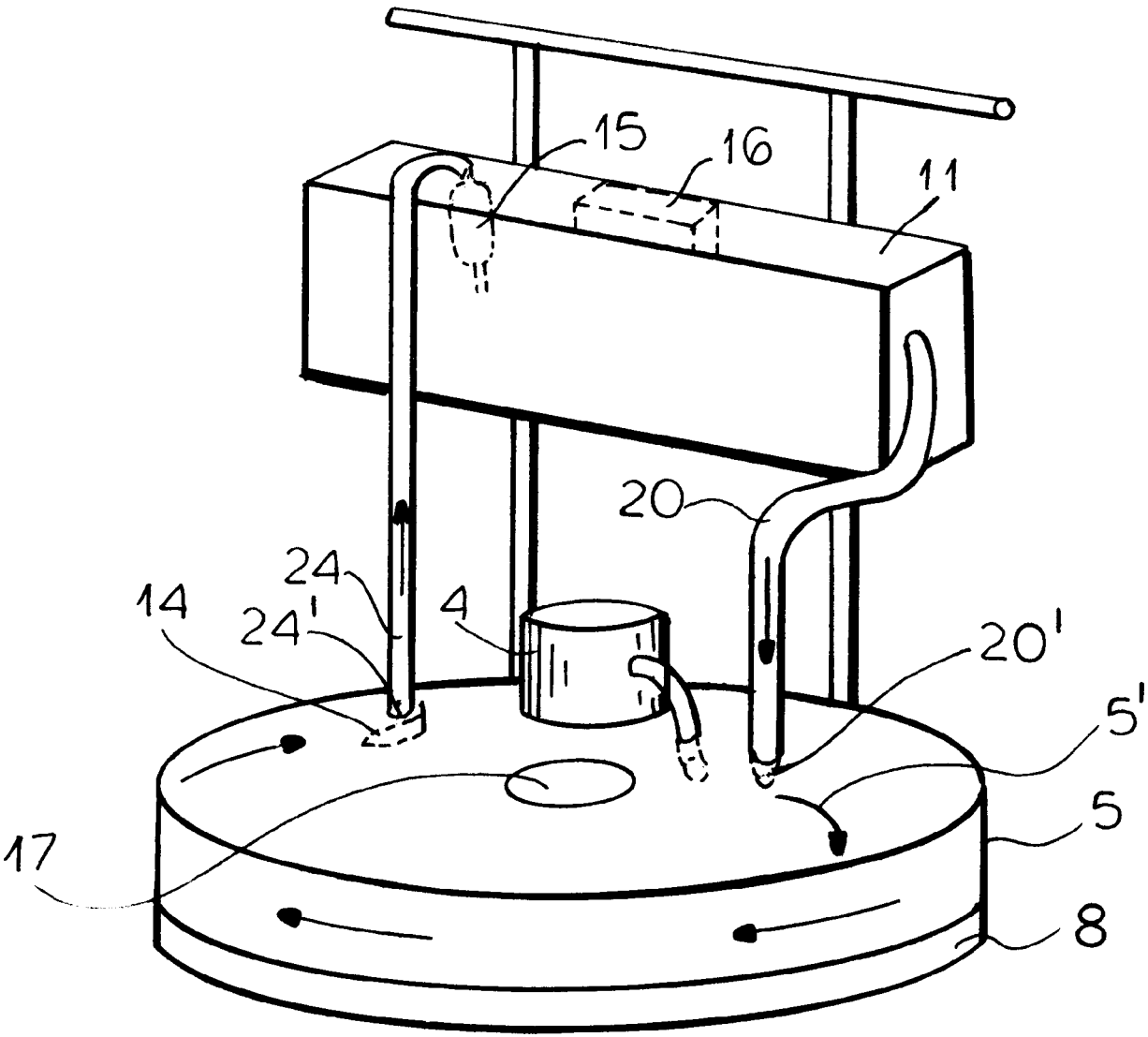
FIG. 1 is an operational diagram in a perspective view of the overpressure process of the invention.
Figure 2:
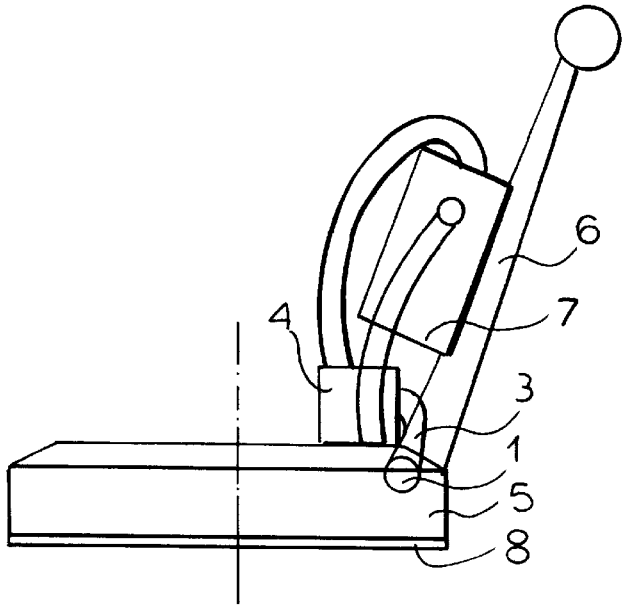
FIG. 2 is a side view of a manually guided machine working according to the overpressure process.
Figure 3:
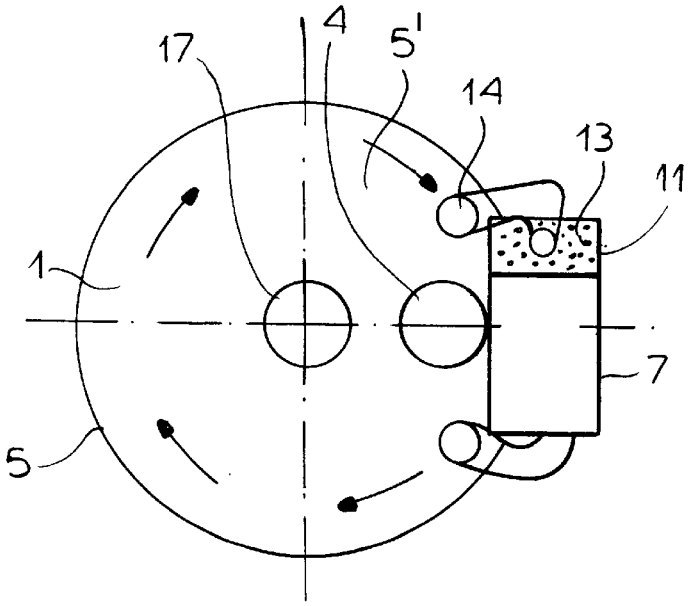
FIG. 3 is a top view of a manually guided machine according to FIG. 2.

FIGS. 1 to 8 show two embodiment examples of the process of the invention with the pertaining machine for the overpressure process.

Embodiment 1

The manually-guided machine consists of an injection nozzle 1 (FIG. 2) whose nozzle junction 2 (FIG. 4) is connected via a hose 3 (FIGS. 2 and 4) with a flow generator 4 (FIGS. 1–4). The housing 5 (FIGS. 1 and 2) designed as a flow channel supports the handling and guide element 6, to which a container 7 for cleaning fluid with a dosage valve is fastened. At the bottom of the housing 5 there is a seal 8, which seals off a circularly shaped flow channel with respect to the surface to be cleaned. Through flow diversion, for instance by baffle plates 10 (FIG. 4), swirling, respectively turbulence is caused in the flow channel. The container 11 (FIG. 1) for solid particles has an opening closeable towards the top for feeding the solid particles and a valve 12 (FIG. 5) mounted on the bottom side of the container.

The container 11 is filled with solid particles up to the full mark. Maintenance agents 16 (FIG. 1) are kept in a separate box in the container 11. A flap 14 which can be vertically actuated from the handling part 6 is built in between the housing 5 and the surface to be cleaned. Above the exhaust air opening 17 made centrally in the housing cover of the housing 5, air is withdrawn.

The flow generator 4 creates an air flow which, via the hose 3 and the nozzle 1 built into the housing, is injected into the flow channel. In this embodiment the housing guides the air flow in a circle (see FIG. 3). When the valve 12 at the bottom of the container opens, the solid particles 13 are introduced from the container 11 into the air flow. Accelerated by the nozzle 1 the solid particles hit the substrate at a certain angle and this way loosen the dirt from the floor through kinetic energy. The solid particles are entrained by the air flow rotating in the housing under overpressure. If sufficient solid particles are set into rotation, the valve 12 is closed and the rotating mixture of air and solid particles is guided over surface to be cleaned.

As already described the surface is cleaned and maintained.

Cleaning agents from the container 7 or maintenance substances from the container 16 are added for the cleaning. If the cleaning is to be terminated, first the solid particles have to be discharged from the circulating air flow. For this purpose the flap 14 is lowered. Then the air flow moves the solid particles over an intermediate filter 15 back into the container 11. The filter 15 separates the dry dirt from the solid particles.

when all solid particles have been discharged from the air flow into the container 11, the air flow generator is turned off. The container 11 with the dirty solid particles is replaced with a container with fresh solid particles. In a separate washing step the solid particles are subsequently cleaned.

Embodiment 2

Figure 5:
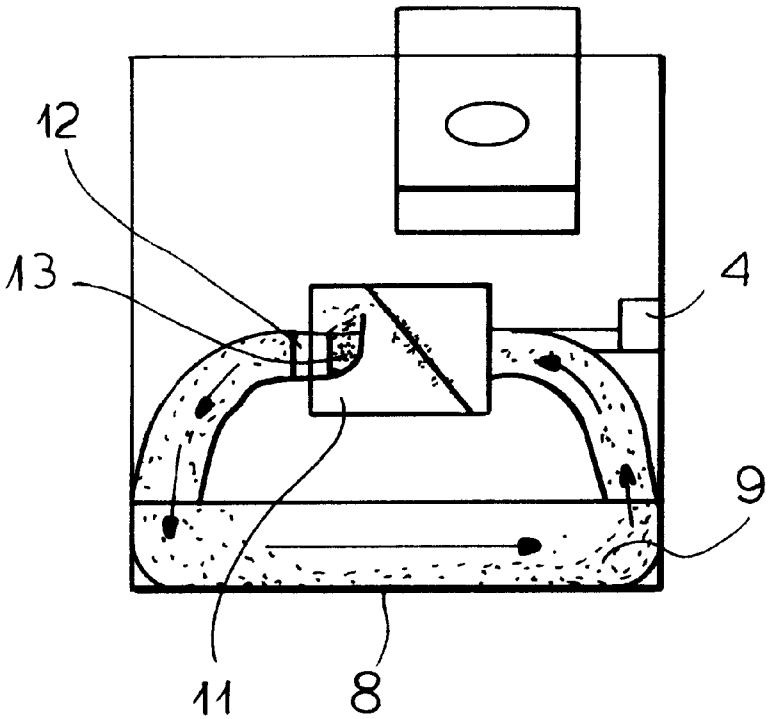
FIG. 5 is a side view of a mobile machine working according to the overpressure process with-flow channels running in the travel direction.
Figure 4:
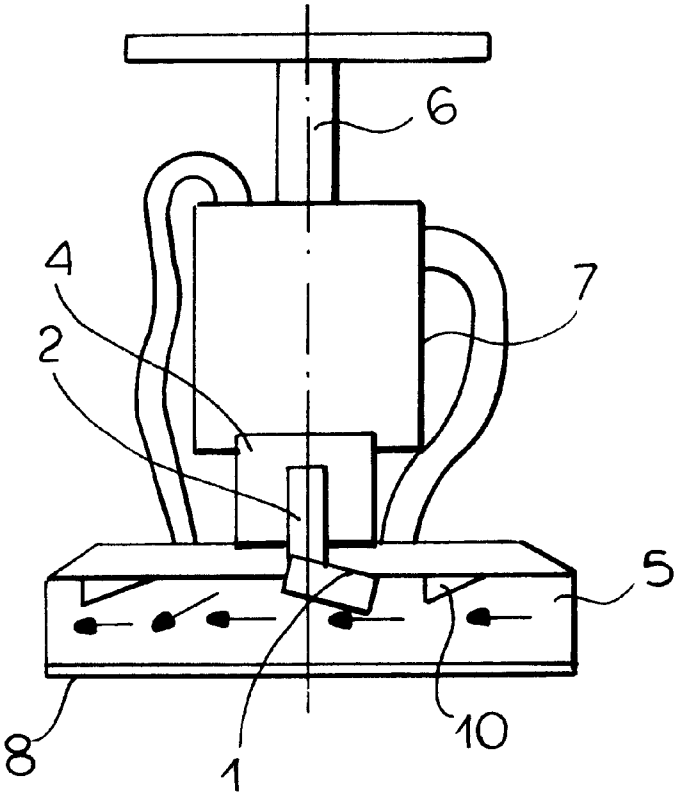
FIG. 4 is a frontal view of a manually guided machine according to FIG. 2.
Figure 6:
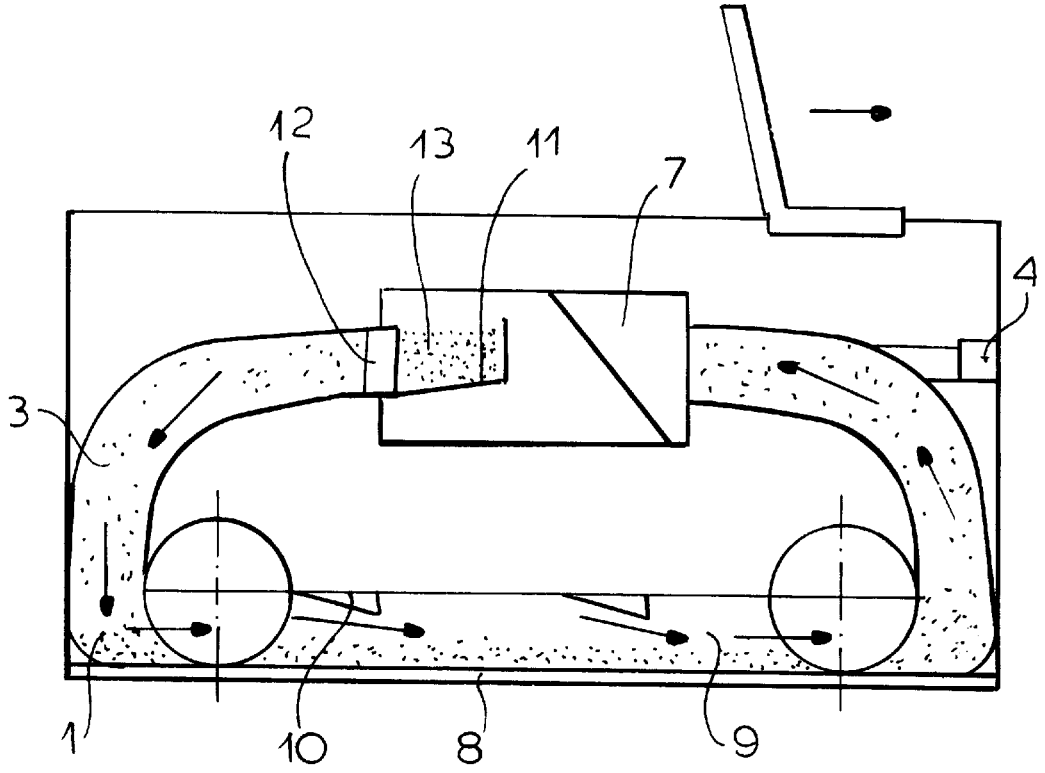
FIG. 6 is a frontal view of a mobile machine according to FIG. 5 with flow channels running transversely to the travel direction.
Figure 14:
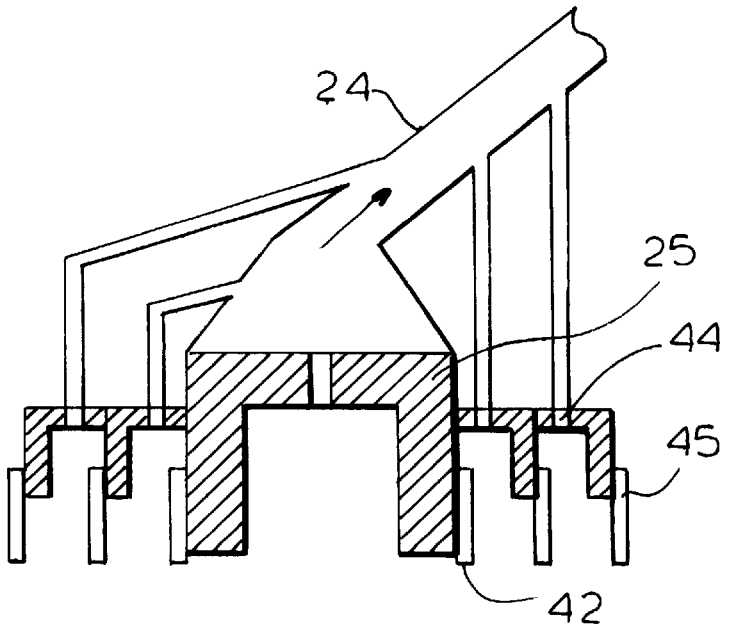
FIG. 14 is a sectional representation of the bottom lip.
Figure 7:
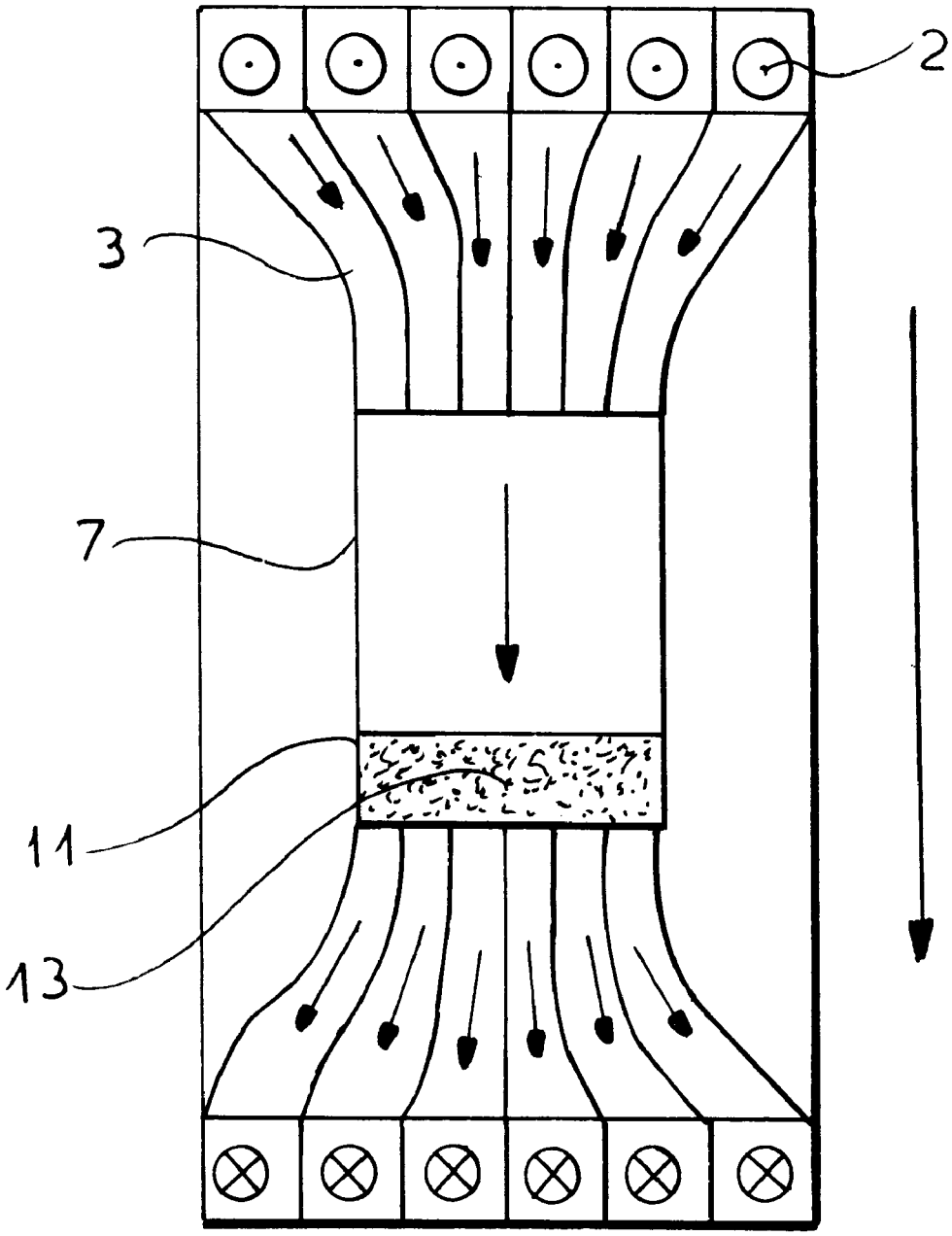
FIG. 7 is a top view of a mobile machine according to FIG. 5 with flow channels running in the travel direction.
Figure 9:
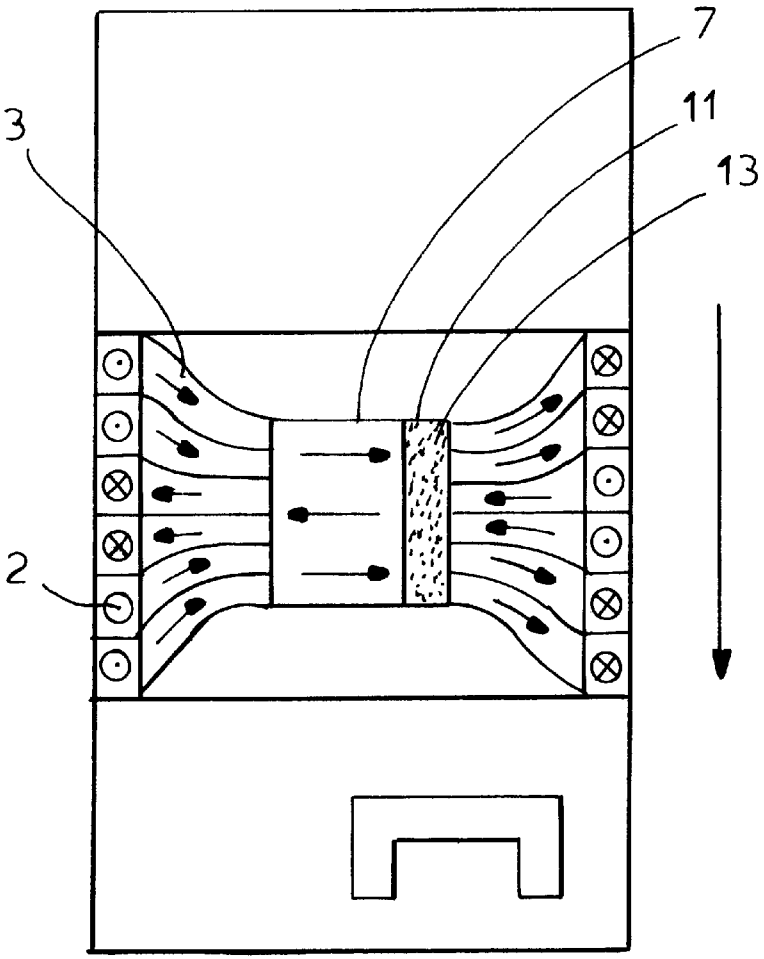
FIG. 9 is a top view of a machine according to FIG. 5 with flow channels running transversely to the travel direction and opposite flow directions.
Figure 8:
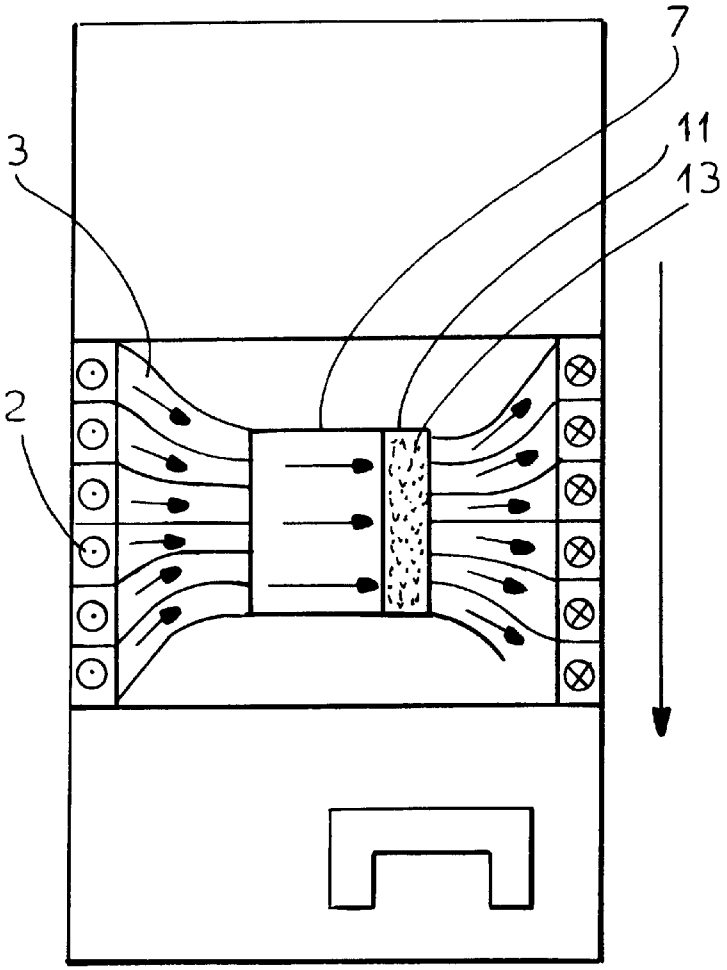
FIG. 8 is a top view of mobile machine according to FIG. 5 with flow channels running transversely to the travel direction.
Figure 10:
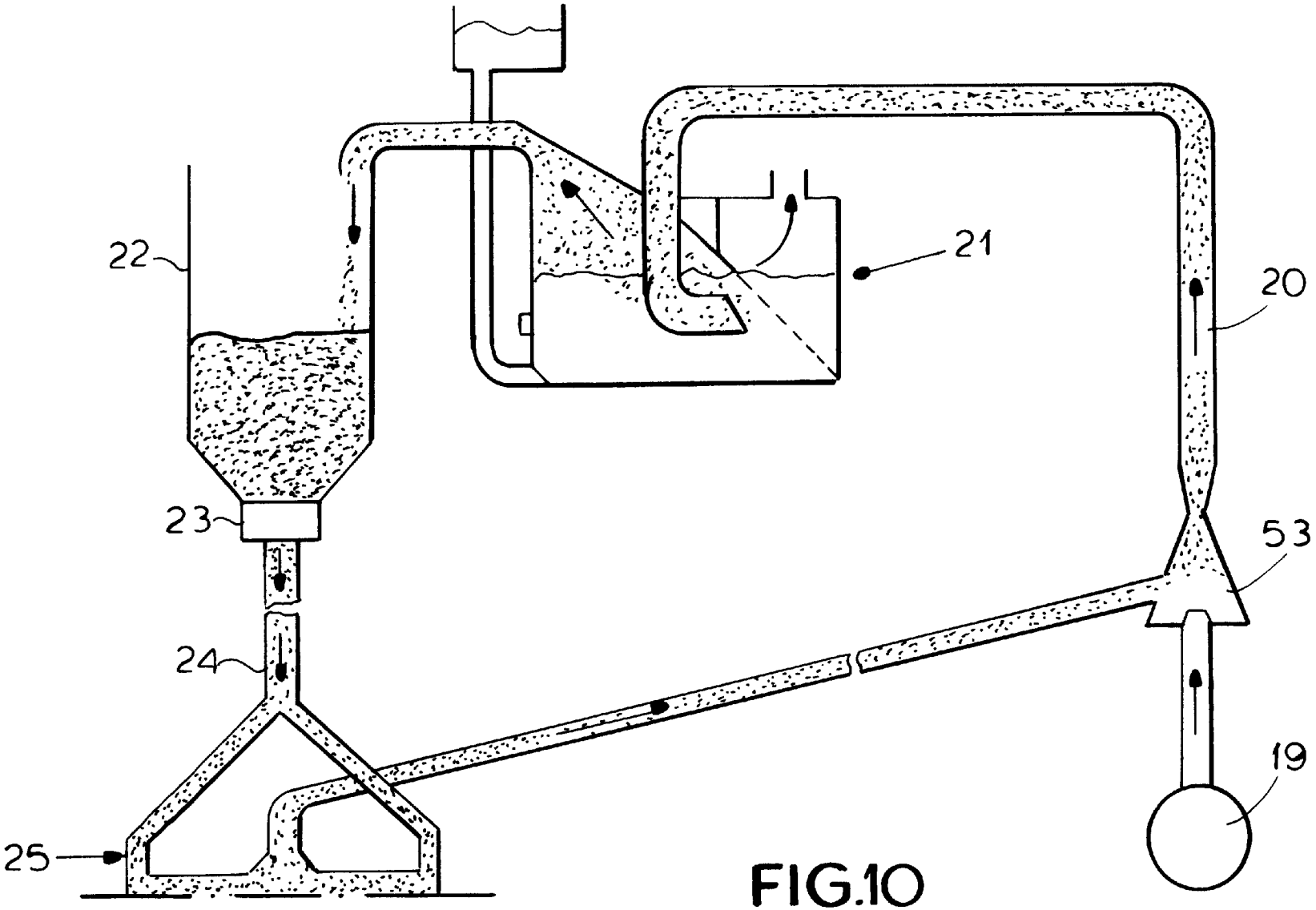
FIG. 10 is an operational diagram of the negative pressure process of the invention,.
Figure 11:
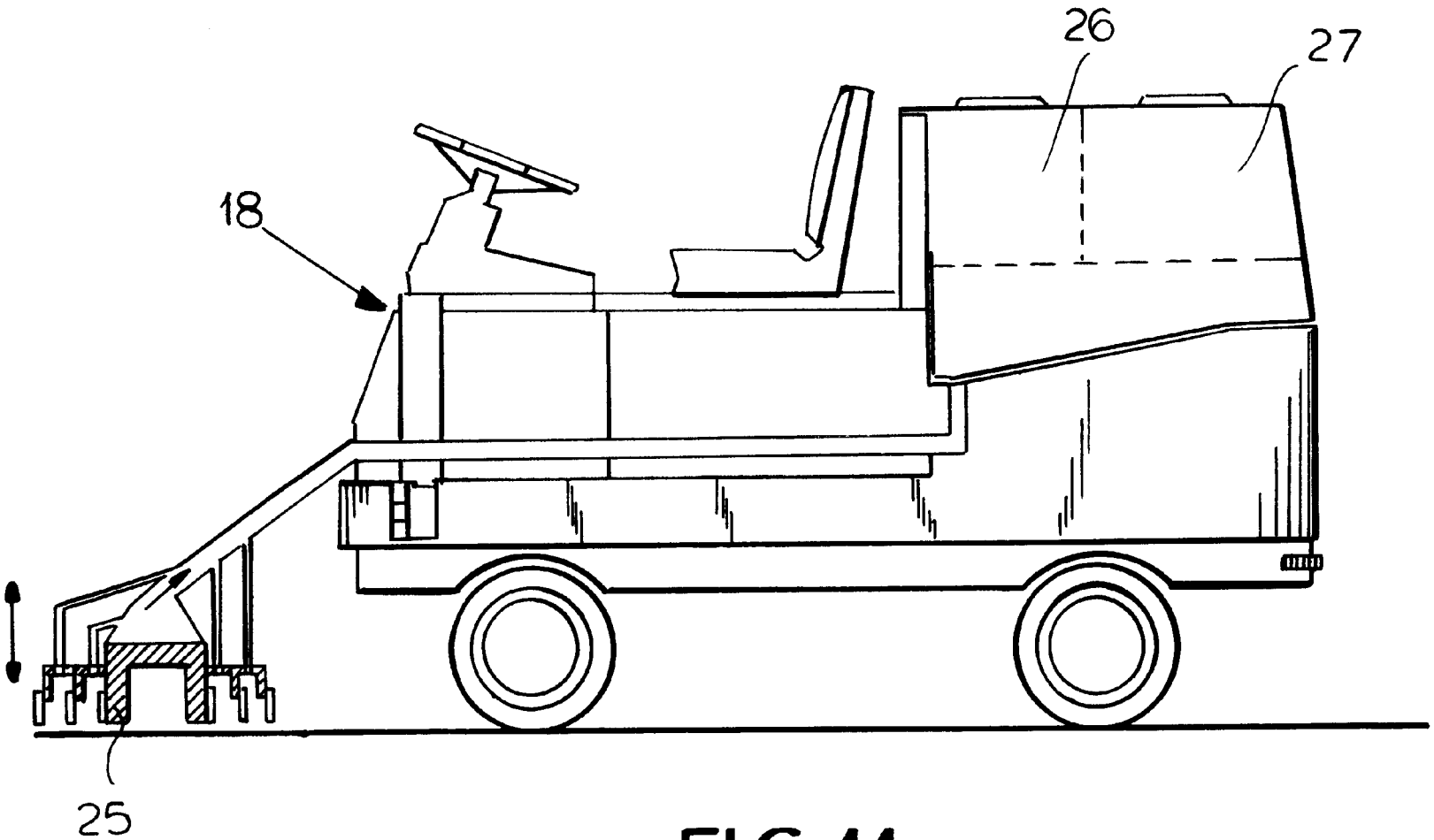
FIG. 11 is a side view of the mobile machine of the invention working according to the negative pressure process.

A mobile machine with a mobile stand and drive via wheels for support, by moans of which the overpressure process of the invention can be carried out, consists as seen from FIG. 5 of an injection nozzle 1, whose nozzle junctions 2 are connected with the flow generator 4 via hoses 3.

This differs from the Embodiment 1 in that separate flow paths 5' are provided in the bottom part of the machine. These flow paths 5' are designed as channels 9 which are open towards the surface to be cleaned.

The handling and guide elements 6 are mounted in the upper rear portion of the vehicle. The container 7 for the cleaning agents and the thereto pertaining dosage valve are located above the flow paths and arranged in the Diddle. Between the flow channels 9 and the surface to be cleaned the seal 8 is arranged.

By means of flow guiding elements, such as baffles 10 (FIG. 6), a turbulent flow is produced in the flow channels 9. The container 11 with valve 12 is filled with solid particles. It is arranged centrally in the machine. As executed in the Embodiment Example 1, the flap 14 is located at the pressure line which leads to the container 11. A filter 15 arranged upstream thereof detaches the loose dirt from the solid particles. The container 16 for maintenance agents is located in the rear central area.

The overpressure of the air flow is reduced through the venting openings 17, which are located between the flow-inlet side and the flow-outlet side of the container.

The flow generator 4 produces an air flow. Via several hoses 3 and nozzles 1, which are built into the housing, this air flow is introduced into the flow channels 9. In this embodiment the flow channels 9 guide the air flow in a straight line.

The container 11 has an upper closeable opening for supplying the solid particles and a frontally exiting valve 12. When the valve 12 is opened, the solid particles 13 are added from the container 11 to the air flow. The solid particles are entrained by the air flow and through the nozzles 1 are blasted at an angle against the substrate. The volume flow is now guided over the surface to be cleaned. Depending on the selected type of solid particles, the cleaning and maintenance take place.

For cleaning, cleaning agents are added from the container 7. Maintenance substances are admixed via the container 16. The air flow moves the solid particles through the container 11, in whose supply line filters 15 are arranged, which detach the rough and dry dirt from the solid particles. Via a separation and cleaning device 21, the solid particles are cleaned to the extent that they can again be guided into the air flow.

For this it is necessary to interrupt the cleaning of the substrate. The solid particles have to be discharged from the rotating volume flow. For this purpose the pressure line 20 closed by the flap 14 in opened and the volume flow is discharged from the container 11 due to the still existing pressure.

If all solid particles have been removed from the flow channels 9, the flow generator 4 is turned off.

FIGS. 9 to 18 show a further embodiment of the invention with the pertaining machine for the negative pressure variant.

In a vehicle 18 (FIG. 11) driven by an energy source (not illustrated), for instance a storage battery, a fan 19 (FIG. 10) producing negative pressure is located, which via a pressure line 20 is connected with a washing and separating device 21. The washing and separating device 21 consists of a container 29., which is divided by a dividing wall 50 into a closed chamber 48 and an upwards open chamber 49. In the dividing wall 50 a separation screen 32 is inserted, which is permeable to the air flow and the cleaning fluid and is completely surrounded by the cleaning fluid, so that the cleaning fluid is present in the chamber 48 as well as in chamber 49. The separating screen 32 is inclined at an angle of approximately 45° with respect to the volume flow and the solid particles.

Starting out from the dividing wall 50 and at the inclination angle of the separation screen 32, a baffle plate 51 runs up to the head 33 of chamber 48. Close to the baffle plate 51 in the head 33 of th chamber 48 ends a conically opening auction line 34, which at the other end enters the upper part of the container 22. Underneath the container 22 there is a funnel-like feeding and dosage device 23, which is connected in a pressure-proof manner with the container 22 via a suction line 24 and which leads upstream to the nozzle system 25, which in turn is connected with its suction opening 41 to the suction side of the fan 19 (see FIG. 10 and 11).

The suction line 24 enters into the injector 53, which receives its negative pressure from the fan 19. The pressure line 20 staring out from the injector 53 leads into the chamber 48 filled with cleaning fluid and has at its end a chamfered elbow 52, which with its opening located exactly opposite to the separating screen 32.

The volume flow of air and contaminated solid particles coming from the nozzle system 25 flows through the suction line 24 towards the injector 53 and reaches the pressure line 20, which as described before leads to the chamber 48.

The volume flow consisting of air and solid particles hits the separating screen 32 almost perpendicularly.

The mesh width of the separating screen 32 is smaller by approximately one third than the largest size (diameter, respectively edge length) of the solid particles. The air flow carrying the solid particles escapes through the mashes 36 of the separating screen 32 into the chamber 49 and is discharged through the air discharge line 34. Due to the buoyancy forces the solid particles reach the liquid surface. The following solid particles press the solid particles which have already reached the surface of the liquid further in the direction of the conical suction line 35 which ends in the head 33 of the chamber 48, through which the solid particles reach the container 22, from where the solid particles are admixed to the air flow at a rate of approximately 30% per liter of air, by means of the feeding and dosage device 23.

With the feeding device the cleaned solid particles are fed into the suction line 24 and with the dosage device takes place the wetting of the solid particles with cleaning fluid or with maintenance agents from the corresponding container 26, respectively 27 provided therefor, which are moved together with the vehicle 18.

Afterwards via the nozzle system 25 the volume flow of air and solid particles reaches the surface to be cleaned, and takes up the dirt. This closes the volume flow cycle.

Figure 12:
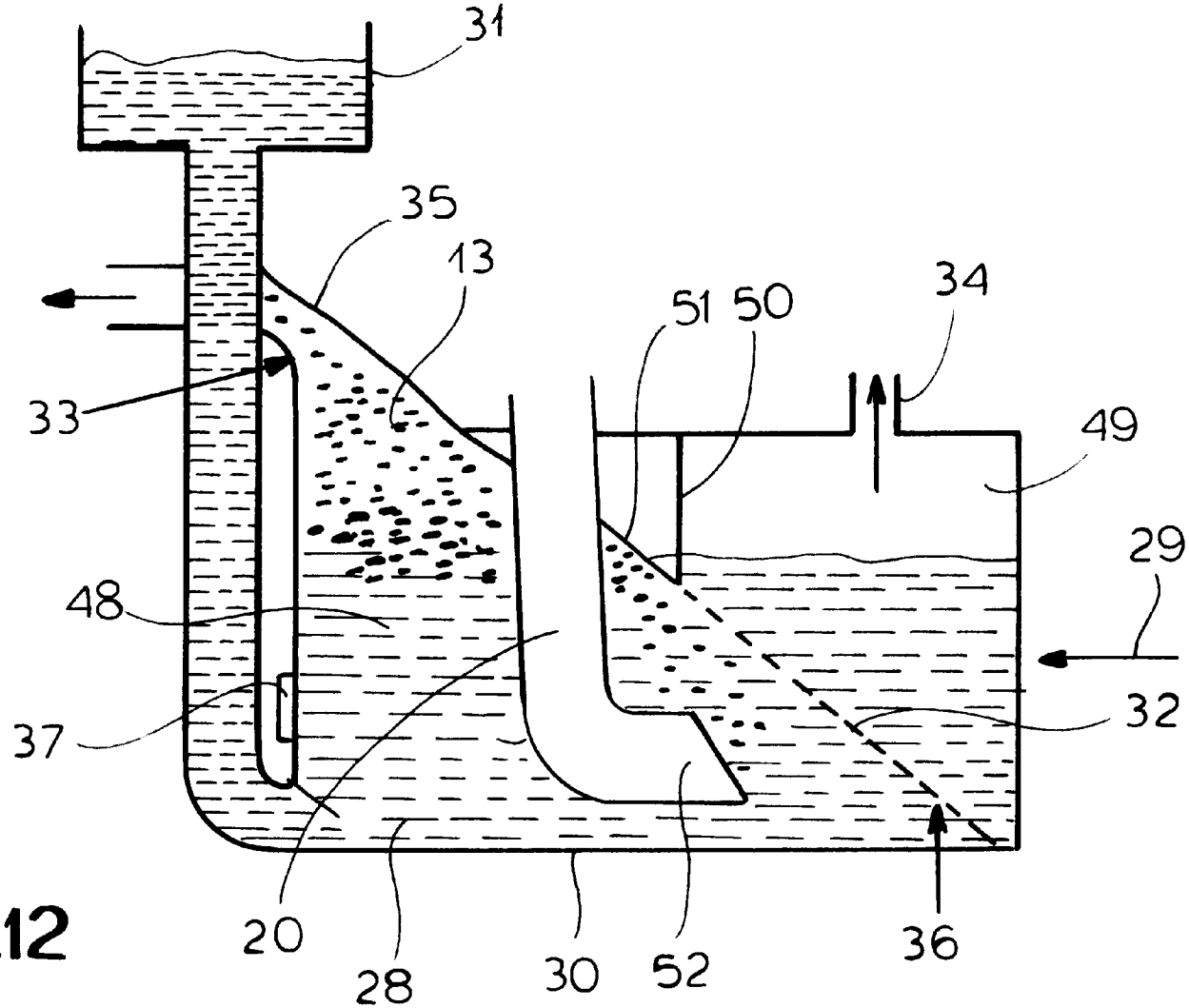
FIG. 12 is a perspective representation of the washing and separating device for the negative pressure process.

The volume flow of air and of contaminated solid particles, aspired through the suction line 24 by the nozzle system 25 due to the fan 19, flows through the pressure line 20 at rate of 3000 l/min with a pressure of 130 mbar towards the container 29 filled with cleaning fluid 28 of the washing and separating device 21 (see FIG. 12).

The level of the cleaning fluid in the chambers 48 and 49 is kept constant via a compensating container 31 communicating with the chamber 48.

The bottom 30 of the chamber 48 of the washing and separation device 21 is provides with a dirt discharge 37, through which the dirt detached from the solid particles can be evacuated.

A mixture of 10% by weight nonionic surfactants, 4% by weight anionic surfactants, the balance being made up by water and preservatives is used as cleaning fluid.

The air flow transports the solid particles through the suction line 24 to the nozzle system 25, which by means of not shown shock absorbers is fastened to the frame of vehicle 18 so that it can be lowered.

Figure 13:
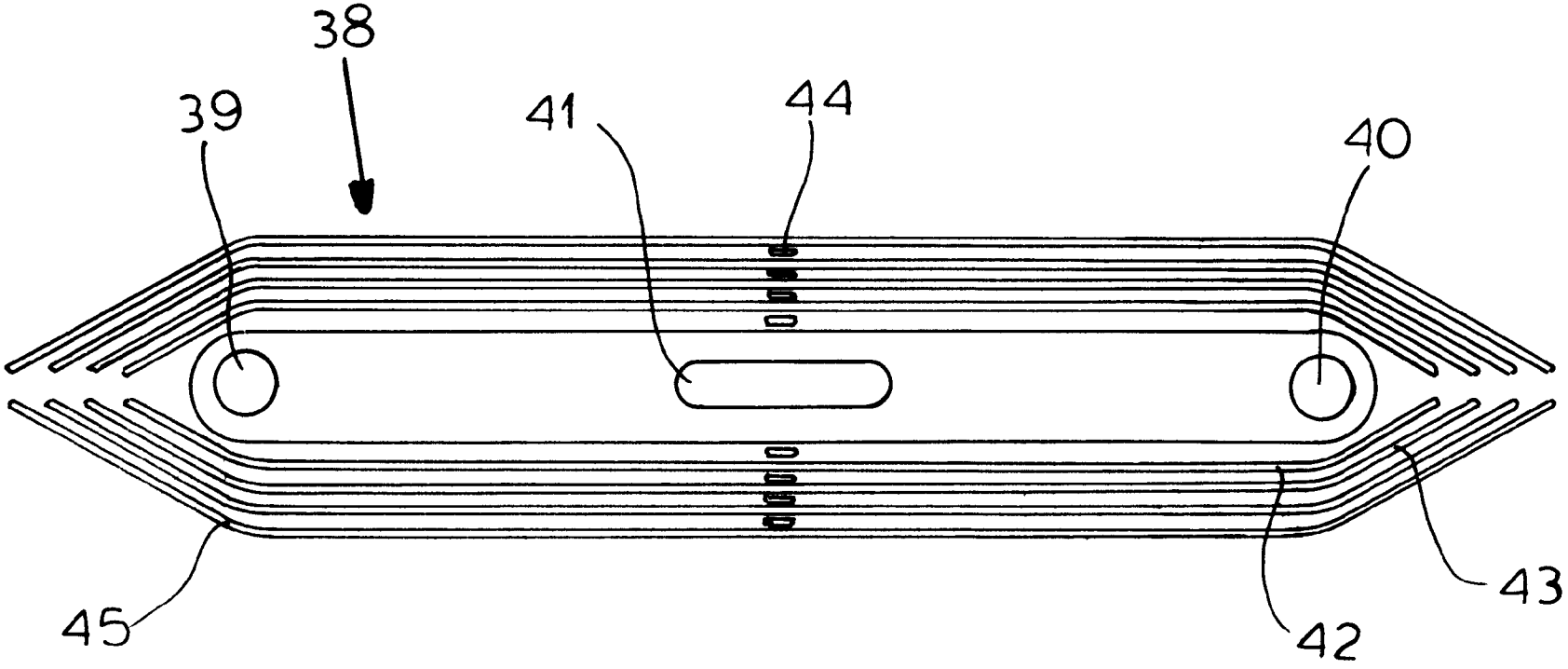
FIG. 13 is a top view of a nozzle with two inlet openings and one outlet opening for the negative pressure process.

According to FIG. 13 the nozzle system 25 consists of an approximately rectangular flat nozzle 38, in whose one short side an inlet opening 39 is located and at its other short side, exactly opposite to the inlet opening 39, a further inlet opening 40 is located. Centrally to both openings 39 and 40, there is a suction opening 41 leading to the suction line 24.

At the suction opening 41 there is a negative pressure of 20 to 50 mbar. The volume flow of air and solid particles guided via the pressure line 20 towards the two inlet openings 39 and 40 divides itself in two approximately equal volume flows A which directed one against the other flow towards the suction opening 41.

In this way a volume flow results which is continuously guided over the surface to be cleaned from the sides of the flat nozzle 38 towards its middle.

The flat nozzle 38 in surrounded by an intrinsically closed inner bottom lip 42. In order to preclude the lateral escape of the solid particles at the inner bottom lip 42, the same is surrounded by a further bottom lip 43 which is open at its sides, so that the surrounding air can be sucked in due to a buildup of negative pressure (see FIG. 14).

Besides this protection system builds a negative pressure ring around the surface to be cleaned, so that the nozzle system 25 remains shielded against the outer air pressure.

Between the inner bottom lip 42 and the outer bottom lip 43 there is an injection opening 44, through which possibly escaped solid particles can be returned to the volume flow. Additional further bottom lips 45 with lateral openings, whose interstices are also equipped with an injector opening, protect against the escape of solid particles depending on the required protection degree.

Figure 15:
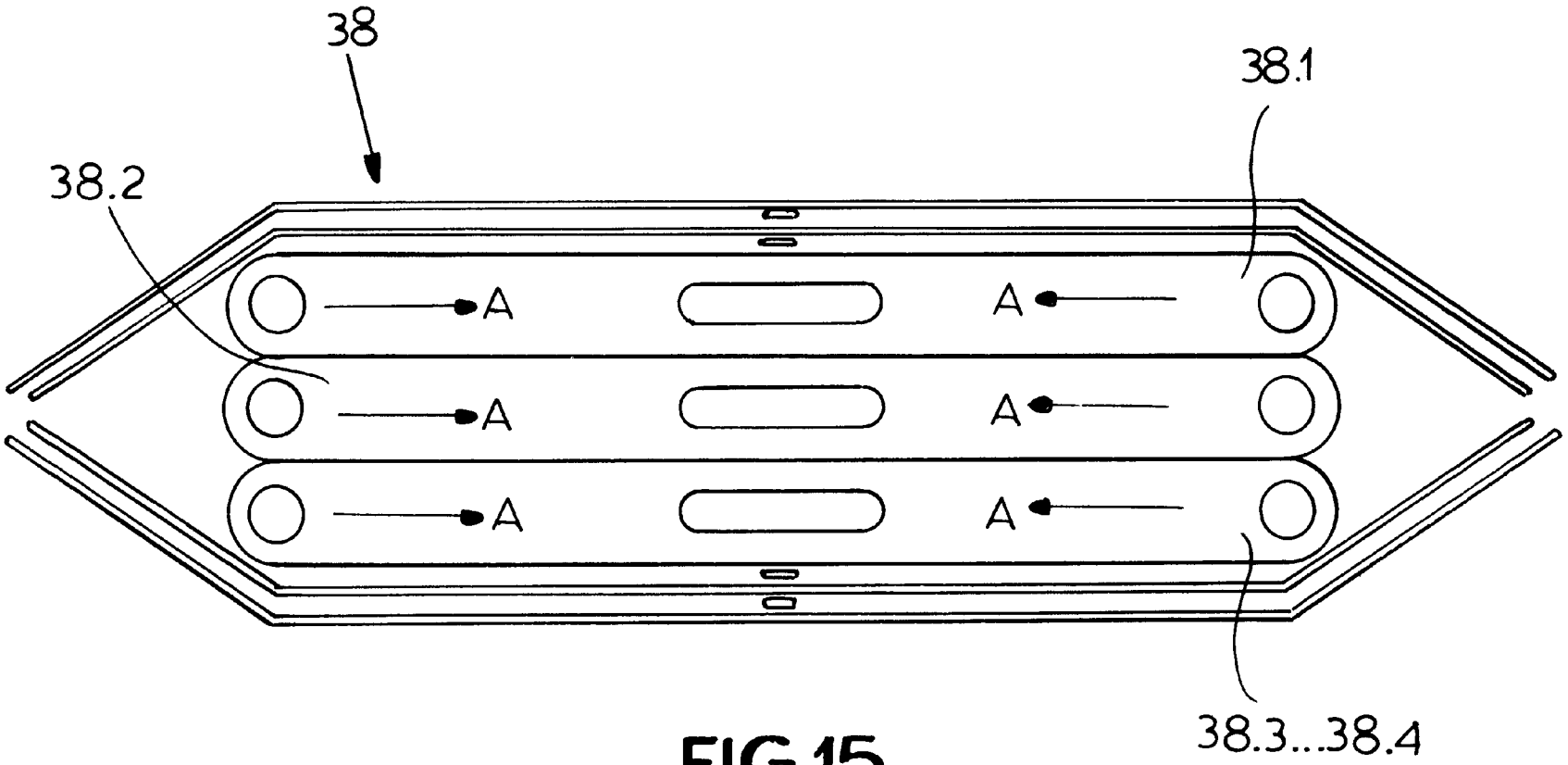
FIG. 15 is a top view of several nozzles according to FIG. 13 arranged in succession.

As shown in FIG. 15, several, for instance three flat nozzles 38 can be arranged in succession and form the nozzle system 25. This makes it possible to clean and/or maintain in different steps.

The first flat nozzle 38.1 is actuated with an air flow which vacuums the rough dirt. This way the solid particles are treated with care and the cleaning process is considerably improved.

Suitably this preliminary cleaning nozzle is movably suspended from the frame in the front of the machine in a v-shaped manner.

With the subsequent second flat nozzle 38.2 a volume flow of air and abrasive solid particles, for instance silicates with an edge length of 2 mm, is directed onto the surface to be cleaned, by means of which encrusted dirt and also old paint residues can be removed.

The third flat nozzle 38.3 makes it possible to apply a maintenance agent, for instance wax, to the surface to be treated, in that soft neopolen bodies with a diameter of 4 mm, wetted with wax, act on the surface.

An air flow directed by the nozzle 38.4 onto the just cleaned surface dries and aspires possible left-over solid particles.

Figure 16:
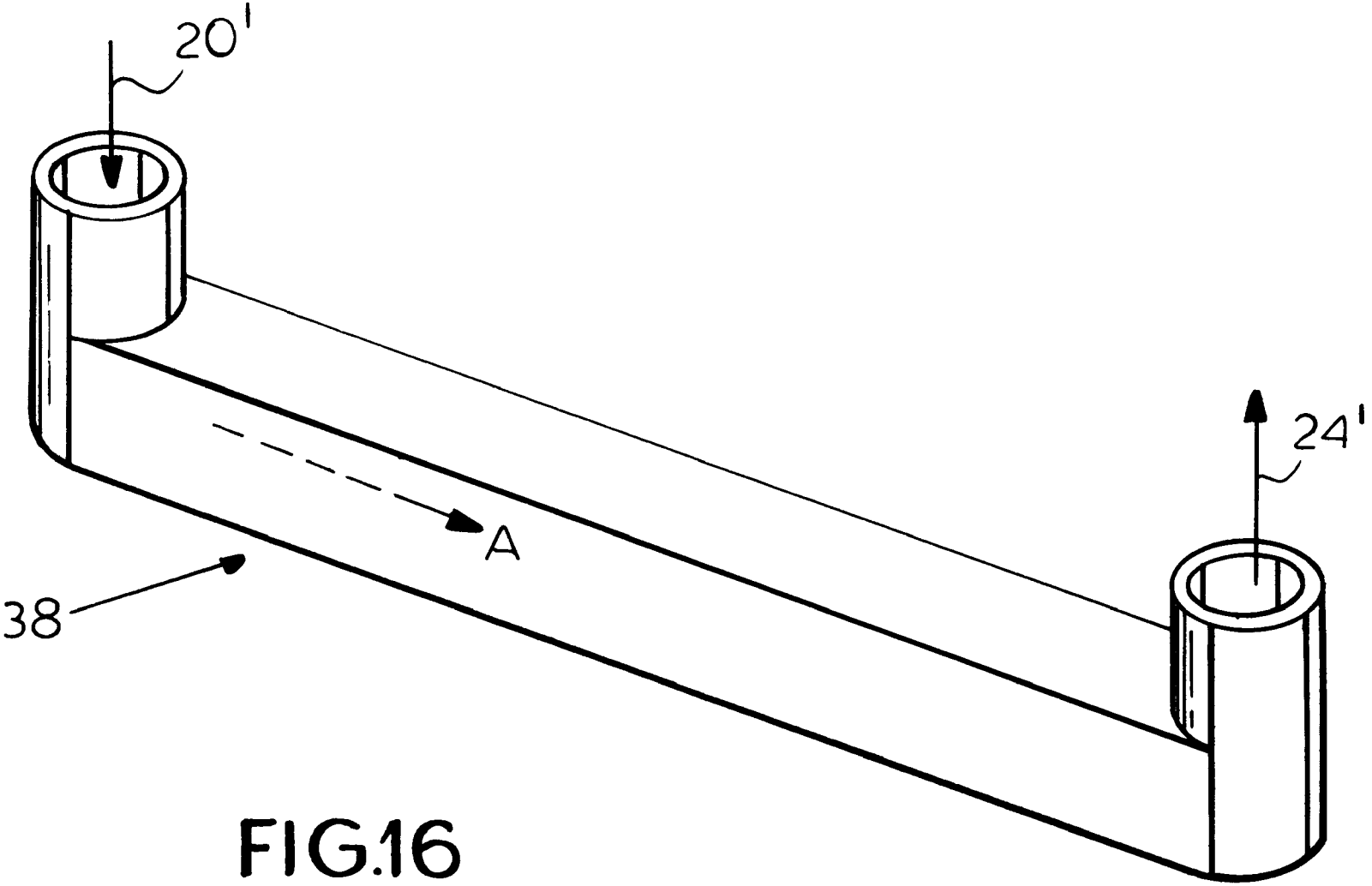
FIG. 16 is a nozzle with one inlet opening and one outlet opening for the negative pressure process.

In FIG. 16 a variant of the flat nozzle 38 is shown, which is rectilinear and which clean for instance from the right to the left. This flat nozzle has only one inlet opening 39 and one outlet opening 41. At the suction opening 41 a negative pressure is applied which sucks up the volume flow with the solid particles from the other side. The lip arrangement corresponds to the aforedescribed construction.

Figure 17:
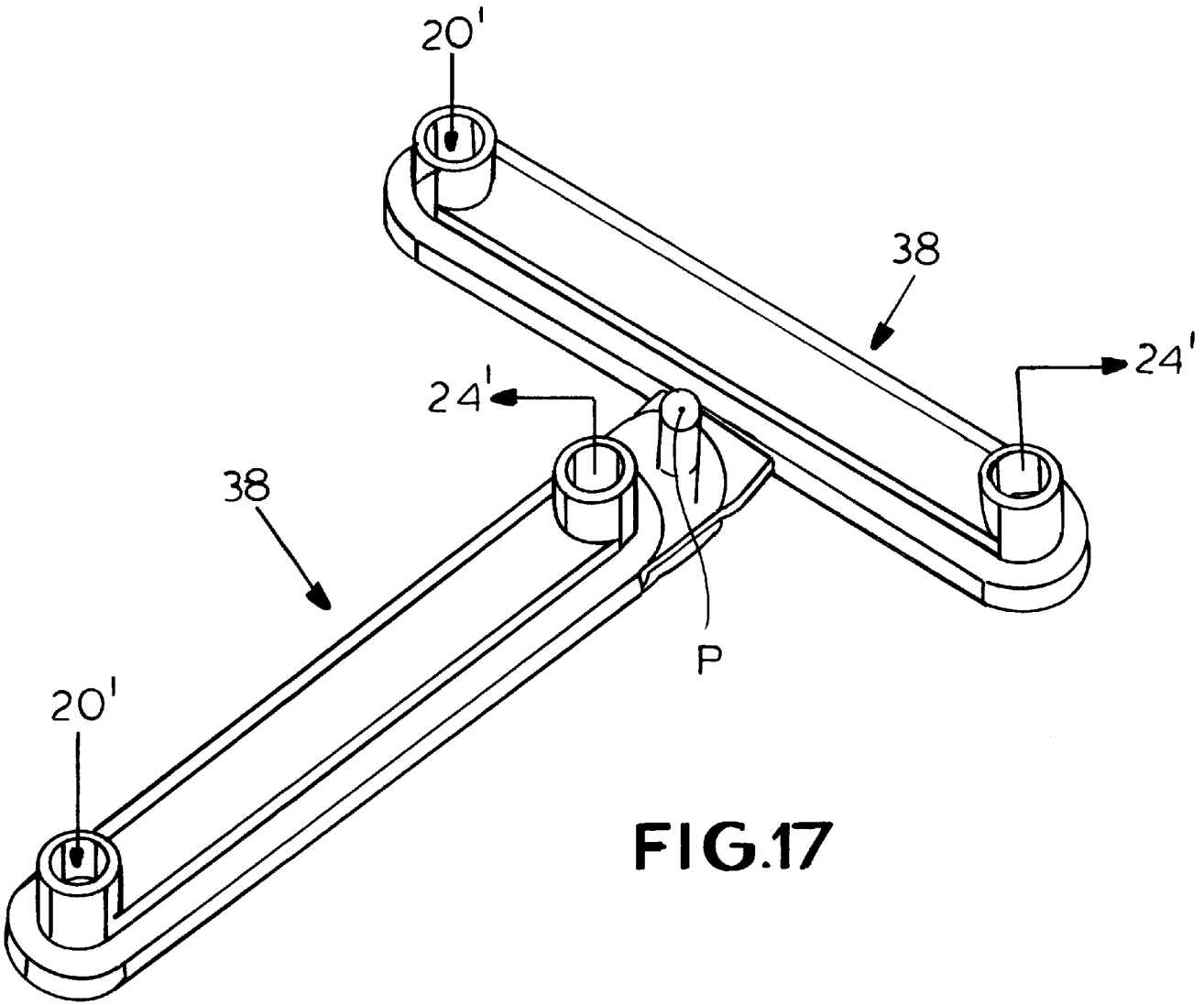
FIG. 17 is a representation of two interconnected nozzles according to FIG. 15 in a perspective view.

In FIG. 17 the interconnection of two rectilinear nozzles 38 into a v-shaped arrangement is shown. The rotation point P of both flat nozzles 38 is located in their frontal area, so that in the vicinity of the rotation point the two nozzle bodies overlap slightly, so that no areas can be formed wherein the cleaning does not take place. In the frontal area of the arrangement the two inlet openings 39 are provided. The volume flow of air and solid particles coming in through these openings is aspired by the suction opening 41 arranged in the rear. Both nozzle arms of the v-shaped arrangement are kept in a stable, for instance slightly angled position with respect to each other, by a tension spring. When this arrangement hits an obstacle during its travel over the surface to be cleaned, the nozzle arms can be pressed inwards and afterwards resume their initial position.

Figure 18:
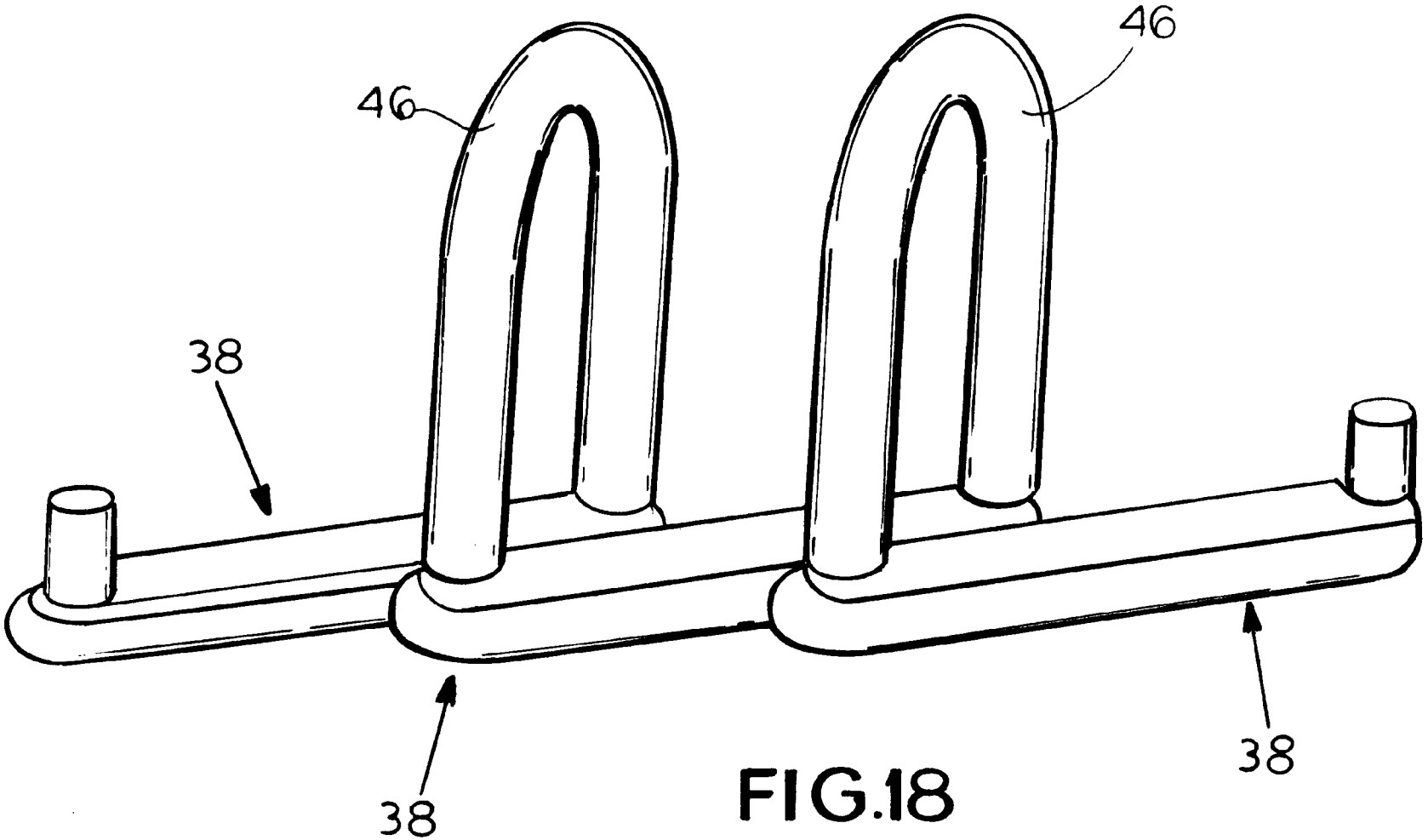
FIG. 18 is a perspective view of the interconnection of three nozzles according to FIG. 15

As shown in FIG. 18, three rectilinear nozzles can be arranged in succession, staggered so that their treatment surfaces overlap. The outlet opening 41 of the first flat nozzle is rotatably connected with the inlet opening 39 of the second flat nozzle, the outlet opening 41 of the second flat nozzle with the inlet opening 39 of the third flat nozzle, all via a pipe elbow. This way the three flat nozzles 38 are scissor-like displaceable with respect to each other, so that the work width can vary.

Figure 19:
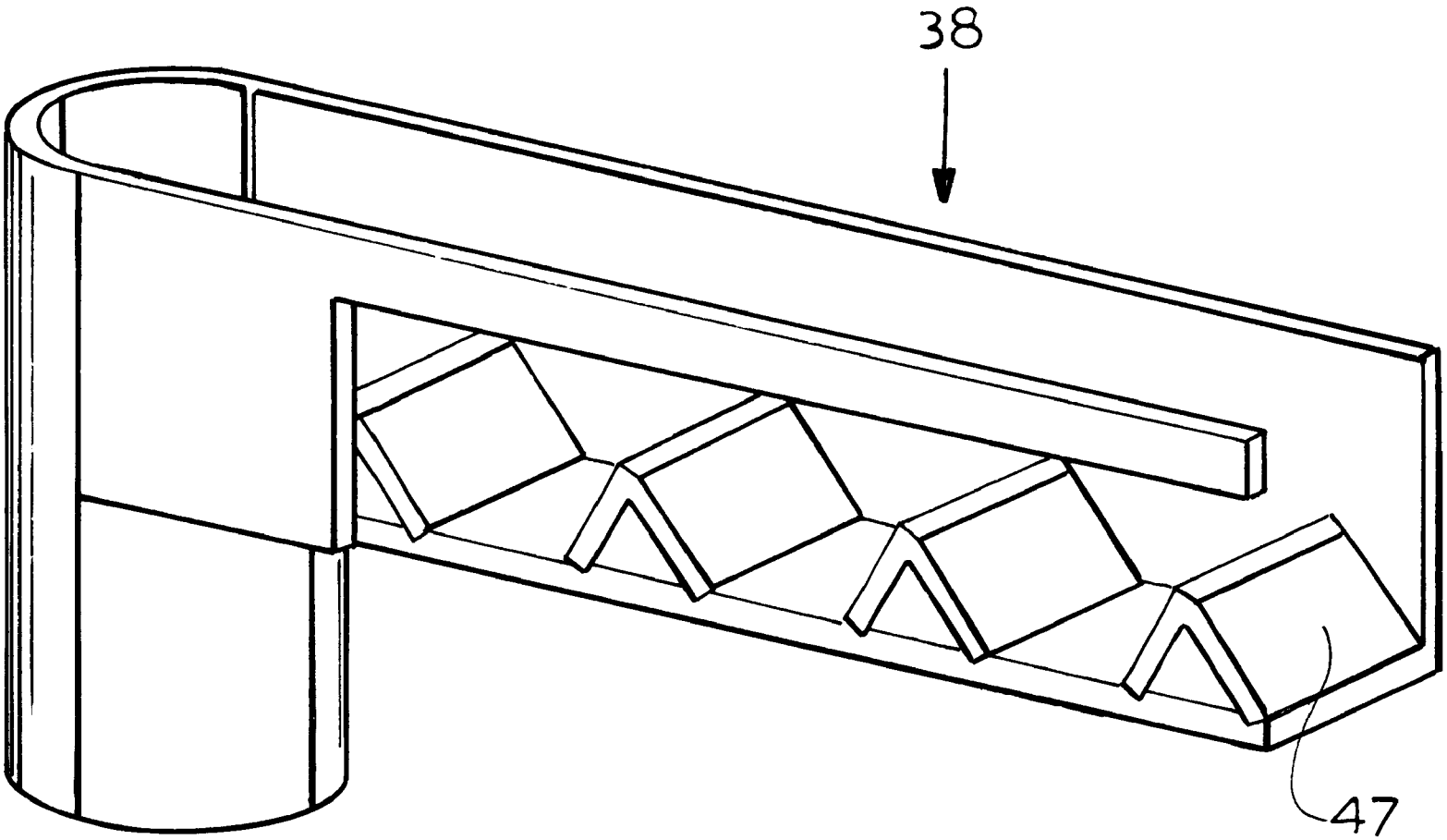
FIG. 19 is a perspective view of the turbulence built into the nozzles according to FIGS. 13 to 17.

In order to improve the turbulence of the solid particles in the volume flow, baffle plates 47 are fastened inside the flat nozzles 38, between the inlet opening 39 and the outlet opening 41 (see FIG. 19).

The nozzle system 25 is connected to the suction side of the fan 19 via suction line 24. This way the volume flow cycle of air and solid particles is closed.

The fan 19 is designed so that air amounts of 2000 to 8000 l/min with a load rate of solid particles of 5 to 50% can be moved in cycle. The negative pressure in the volume flow equals 100 to 200 mbar.

At the outlet openings 41 of the flat nozzles 38 a negative pressure of 20 to 50 mbar exists.

What is claimed is:

1. A process for treating a surface of floors or walls comprising the steps of:

(a) forming an underpressure ring around a portion of said surface to be treated, thereby shielding said portion against external atmospheric pressure and enclosing said portion in a chamber;

(b) continuously supplying air to said chamber and to said portion of said surface and charging the supplied air with 5 to 50% per liter of the supplied air with solid particles superficially wetted with liquid treating agent;

(c) withdrawing air from said chamber entraining soiled solid particles therewith;

(d) separating the soiled solid particles from entraining air, cleaning said soiled solid particles to form clean particles, wetting said clean particles with said liquid treating agent, and returning the clean particles wetted with said liquid-treating agent to the air continuously supplied to said chamber;

(e) advancing said chamber over additional portions of said surface while continuing steps (b) through (d); and (f) selectively displacing at least one air stream over said portion of said surface in a predetermined direction with respect to the advance of said chamber with an overpressure of 20 to 50 mbar, and exhausting an air stream from said chamber at an underpressure.

2. The process defined in claim 1 wherein in said chamber the air supplied thereto is subdivided into two substreams directed counter to one another and the air withdrawn from said chamber is withdrawn from a central exhausting point, said substreams being directed to said central exhausting point.

3. The process defined in claim 1 wherein said air flows through said chamber in an air stream running to an exhausting point at which the air is withdrawn from said chamber in step (c).

4. The process defined in claim 1, further comprising the step of inducing turbulence in the air and particles in said chamber.

5. The process defined in claim 1, wherein air is passed through said chamber in a volume flow rate of 2000 to 8000 liters per minute.

6. The process defined in claim 1, wherein a negative suction pressure of 100 to 200 mbar is applied to said chamber.

7. The process defined in claim 1 wherein the underpressure in said ring is maintained at 20 to 50 mbar.

8. The process defined in claim 1 wherein the air stream supplied in step (b) to said chamber is charged with the solid particles to a load rate of 20 to 30%.

9. The process defined in claim 1 wherein said solid particles are selected from the group which consists of plastic granulate, foamed glass granulate, silicate particles, steel wool or particles of fleece or shredded textile.

10. The process defined in claim 9 wherein said solid particles have irregular shapes and an edge length in excess of 0.3 mm.

11. The process defined in claim 9 wherein said solid particles are spherical, have a diameter of 0.3 to 10 mm and a porous surface.

12. The process defined in claim 1 wherein said liquid-treating agent is selected from the group consisting of a cleaning agent, a polymer, or a wax.

13. The process defined in claim 1, further comprising the step of vibrating said particles for cleaning same.

14. The process defined in claim 1 wherein said solid particles are cleaned by passing upwardly through a liquid bath and are drawn off the bath by negative pressure after cleaning.

15. The process defined in claim 14 wherein said liquid bath includes 5 to 15% by weight nonionic surfactant and up to 3% by weight anionic surfactant.

16. An apparatus for treating a surface of floors or walls comprising:

means forming an underpressure ring around a portion of said surface to be treated, thereby shielding said portion against external atmospheric pressure and including said portion in a chamber;

means including a blower for continuously supplying air to said chamber and to said portion of said surface and a container for receiving solid particles and an admixing device for charging the supplied air with 5 to 50% of solid particles superficially wetted with a liquid-treating agent;

means including a suction line connected to said chamber for entraining soiled solid particles with withdrawn air;

means connected to said suction line for separating the soiled solid particles from entraining air, cleaning said soiled solid particles to form clean particles, wetting said clean particles with said liquid-treating agent and returning the cleaned particles wetted with liquid-treating agent to the air continuously supplied to said chamber; and means for advancing said chamber over additional portions of said surface.

17. The apparatus defined in claim 16 wherein said admixing device for charging the supplied air with said solid particles includes a switchable device for periodic separation of the container from the air stream entering said chamber.

18. The apparatus defined in claim 17 wherein the container is a replaceable cassette.

19. The apparatus defined in claim 16 wherein the means for continuously supplying air to said chamber includes a flow channel opening toward said portion of said surface and having a trapezoidal or rectangular cross section.

20. The apparatus defined in claim 16 wherein said means forming said underpressure ring includes at least one flexible sealing lip.

21. The apparatus defined in claim 16, further comprising a vibration generator for subjecting said solid particles to vibration.

22. The apparatus defined in claim 16 wherein said chamber is in the form of a flat nozzle.

23. The apparatus defined in claim 22 wherein a plurality of said flat nozzles are oriented in a V-manner with respect to one another.

24. The apparatus defined in claim 22 wherein at least three flat nozzles are arranged in succession in a staggered pattern.

* * * * *